US005301583A

United States Patent [19]

Kakko-Chiloff

[11] Patent Number: 5,301,583

[45] Date of Patent: Apr. 12, 1994

[54] ROTARY CUTTING APPARATUS

[75] Inventor: Nicolas Kakko-Chiloff, Olivet, France

[73] Assignee: Usinage Montage Et Assistance Technique, Loiret, France

[21] Appl. No.: 990,438

[22] Filed: Dec. 15, 1992

[30] Foreign Application Priority Data

Dec. 16, 1991 [FR] France ..... 91 15587

[51] Int. Cl.[5] ..... B26D 1/36; B26D 1/42

[52] U.S. Cl. ..... 83/344; 83/346; 83/659; 83/663

[58] Field of Search ..... 83/331, 344, 346, 347, 83/348, 659, 663, 665

[56] References Cited

U.S. PATENT DOCUMENTS 3,348,477 10/1967 Taylor, Jr. et al. ..... 83/663
4,359,919 11/1982 Fuchs et al. ..... 83/348
4,455,903 6/1984 Kesten ..... 83/659
4,507,996 4/1985 Kesten ..... 83/346
4,770,078 9/1988 Gautier ..... 83/663
5,058,472 10/1991 Kakko-Chiloff ..... 83/344

*Primary Examiner*—Richard K. Seidel
*Assistant Examiner*—Allan M. Schrock
*Attorney, Agent, or Firm*—Ralph H. Dougherty

[57] ABSTRACT

The apparatus comprises, between each pair of upper and lower bearing blocks, a shim or strut which provides a support for two bearing blocks on one another. Each of the upper bearing blocks is extended, in an upper portion and toward an inside of said apparatus, by a cantilevered portion subjected to action, in a downward direction, of a pressure exerting vertical jack mounted in an upper portion of said apparatus. A vertical and transverse plane containing a central axis of each pressure exerting vertical jack is situated between a vertical and transverse plane in which is situated a shim or strut placed between the bearing blocks and a vertical and transverse plane of raceways for an upper cutting cylinder and a lower cutting cylinder.

4 Claims, 1 Drawing Sheet

ROTARY CUTTING APPARATUS

FIELD AND BACKGROUND OF THE INVENTION

The present invention relates to a rotary cutting apparatus usable more particularly in printing and forming lines of cardboard collapsible boxes and self-adhesive labels.

These apparatus are generally based on the rolling principle on one another of two superimposed cylinders of parallel axes, of which one, namely the cutting cylinder as such, is engraved in relief, while the other one or "anvil" cylinder is smooth. However, in some processes, the two cylinders can present complementary engravings. The driving into rotation of the two cylinders, at the same peripheral speed but in reverse directions, is provided by connection gears of same working diameter chosen in such manner that there remains, between the two cutting cylinders, a small constant distance necessary for providing a good cut of the cardboard or paper sheet passing therebetween, without however a contact between the metallic parts ensuring the cut.

The interval separating the two cutting cylinders of parallel axes is provided by rollers or raceways which are secured at both ends of the two cutting cylinders while being perfectly concentric therewith. The diameter of each of these rollers is equal to the working diameter of the connection gear. Thus the cutting pressure can be applied without reservation on the two cylinders.

The diameter of the cutting cylinders, which depends on the cut-out format, has also to be determined, as a function of the paper width, in such manner that the deflections appearing during the cut, added to the manufacturing tolerances, are not superior to the theoretical distance separating the cutting parts. The deflections which appear during the cutting operation have two origins : the deflection as such of the cylinders under the effect of a load which is punctual or uniformly distributed due to the cutting effort, and the deflection caused by the flexing moments due to the effort exerted on the cylinder spindles.

Yet, it is necessary, mainly for certain works requiring a great precision and a cut which is clean and without dust, to maintain a deflection, that is a camber of the cutting cylinder which is as small as possible during the cutting operation as such. In order to reduce this camber or deflection of the cutting cylinder, it is of course possible to consider using a cutting cylinder of large diameter, but this entails a high cost for the tooling and reception structure.

As disclosed in French patent 2,645,790, it has also been provided to suppress the second deflection, that is the deflection caused by the flexing moments, by using a particular disposition of the hydraulic jacks.

In "IRON AND STELL ENGINEER", vol. 46, no. 12, December 1969, Pittsburgh US pages 69-87, M. D. Stone has disclosed a Backup Roll Bending for Crown and Gage Control using counter flexing means currently used in rolling mills, and utilizing counter pressure cylinders.

In the above device, the main force is applied on the bearing blocks and the counter-flexion is obtained by a spacing apart of the spindles.

The prior art has also shown U.S. Pat. No. 4,608,895 J. L. Bell et al. and U.S. Pat. No. 4,732,082 C. Ireton ; as well as German patent application published under No 1,243,000 F. L. Smithe Machine Company ; French patent application published under No 21578,193 J. Lacan ; and British patent specification No 398,169 A. Bingham et al.

PURPOSE AND SUMMARY OF THE INVENTION

The present invention relates to improvements to a rotary cutting apparatus of the aforementioned type which enable reducing very substantially the deflection or camber undergone by the cutting cylinder during a cutting operation.

To this effect, the rotary cutting apparatus comprises a frame supporting, between two vertical parallel uprights, two superimposed and parallel cutting cylinders, namely an upper cutting cylinder and a lower cutting cylinder respectively rigidly associated with raceways rolling onto each other, two opposite axial spindles of the upper cutting cylinder being respectively rotatably mounted in two opposite upper bearing blocks slidable vertically on the two respective uprights, while two opposite coaxial spindles of the lower cutting cylinder are respectively rotatably mounted in two opposite lower bearing blocks slidable vertically on the two respective uprights and situated respectively below the upper bearing blocks, each of the upper bearing blocks being extended, in an upper portion and toward inside of the apparatus, by a cantilevered portion subjected to action, in a downward direction, of a pressure exerting vertical jack mounted at an upper portion of the apparatus, while each of the lower bearing blocks is extended, in a lower portion and toward inside of the apparatus, by a cantilevered portion extending above an abutment carried by a corresponding upright of the two respective uprights and with which it is in contact, and includes further, between each pair of upper and lower bearing blocks, a shim or strut which provides the two blocks to bear on one another, a vertical and transverse plane containing a central axis of each pressure exerting vertical jack is situated between a vertical and transverse plane in which is situated the shim or strut placed between the bearing blocks and a vertical and transverse plane of the raceways of the two cylinders.

BRIEF DESCRIPTION OF THE DRAWINGS

By way of a non limiting example, an embodiment of the present invention will be described hereafter, with reference to the accompanying drawings, in which.

DISCLOSURE OF A PREFERRED EMBODIMENT

Figure 1:
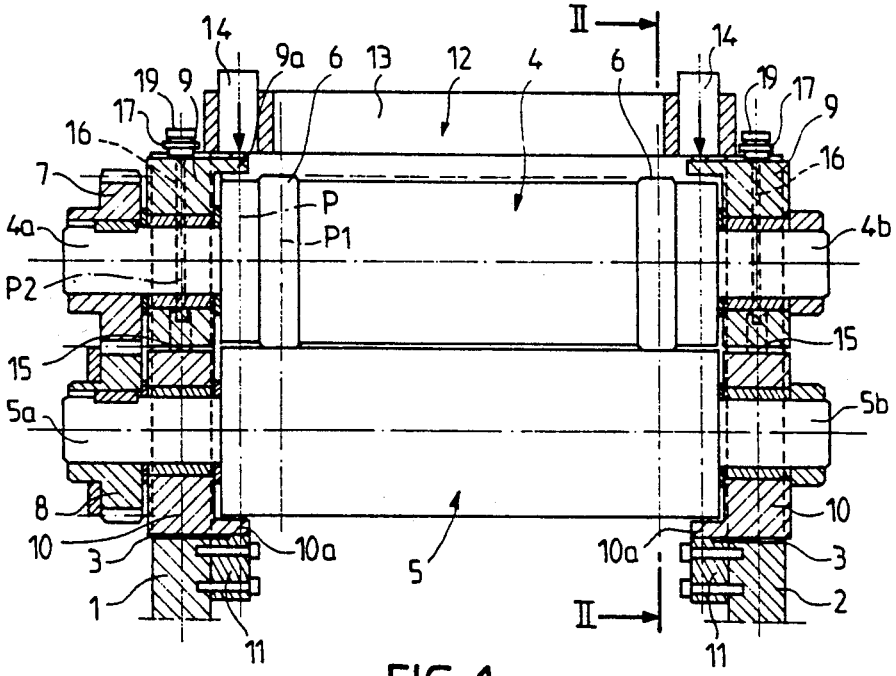
FIG. 1 is a vertical and longitudinal cross sectional view of a rotary cutting apparatus according to the invention.
Figure 2:
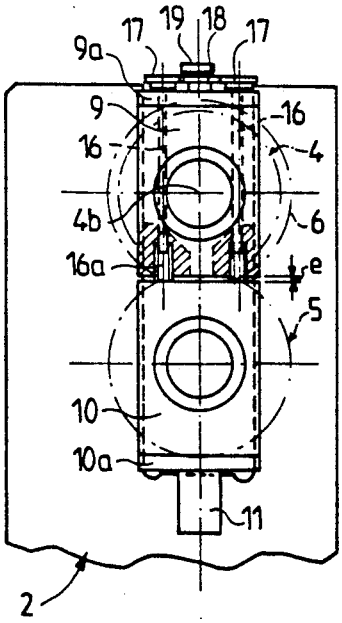
FIG. 2 is a vertical and transverse cross sectional view taken along line II—II of FIG. 1.

Referring now to the drawings, the rotary cutting apparatus shown in FIGS. 1 and 2 comprises a frame made of two parallel vertical uprights 1, 2 connected together by horizontal cross-pieces, not shown. Each of the uprights 1, 2 is cut, at its upper portion, with an aperture 3 extending vertically, of a rectangular shape and opening in the upper horizontal face of the upright.

In the two opposed apertures 3, there is engaged an interchangeable cutting device made essentially of two, upper 4 and lower 5, cutting cylinders, of parallel horizontal axes, and between which a paper or cardboard sheet to be cut will pass.

The upper cutting cylinder 4 is extended at both ends by two coaxial spindles 4*a*, 4*b*, and is readily connected to two raceways 6 situated at a distance from the two frontal faces of the cutting cylinder 4 and between which is provided the engraved portion of the cylinder 4. In the same manner, the lower cutting cylinder 5 which can be smooth ("anvil" cylinder), or engraved, is extended at both ends by two coaxial spindles 5*a*, 5*b*.

The upper raceways 6 roll on the periphery of the smooth lower cylinder 5 which constitutes then, in the case of such an "anvil" cylinder, two lower raceways in the two areas of contact with the upper raceways, and they are of a same diameter which is slightly superior to that of the upper cutting cylinder 4, so as to maintain between the two cutting cylinders 4 and 5 a small interval which is required for providing a good cut of the cardboard or paper sheet passing therebetween, without there being however a contact between the metallic parts providing the cut.

The diameter of the upper raceways 6 is equal to that of the lower anvil cylinder 5 and to the working diameter of connection gears 7, 8, respectively rigidly connected to the left-hand side spindles 4*a*, 5*a* (in FIG. 1) of the cutting cylinders 4, 5, outside the left-hand side upright 1. The connection gears 7, 8 are in mesh with one another and are driven in rotation from the general control unit of apparatus.

The spindles 4*a*, 4*b* and 5*a*, 5*b* of the cutting cylinders 4, 5 are respectively rotatably mounted in superimposed bearing forming blocks, namely upper bearing blocks 9 and lower bearing blocks 10, narrowly engaged in the apertures 3, and which can slide vertically in these apertures.

Each upper bearing block 9 is extended in its upper portion and toward the inside of the apparatus by a cantilevered portion 9*a* extending above the extreme portion of the upper cutting cylinder 4. In the same way, each lower bearing block 10 is extended, in its lower portion and toward the inside of the apparatus, by a cantilevered portion 10*a* which extends below the extreme portion of the lower cutting cylinder 5 and above a fixed built-in abutment 11. The abutment 11 is fixed by means of screws on the inner face of the corresponding upright 1, 2, so that its upper horizontal face is situated at a level which is slightly above the position of the lower edge of the aperture 3. Therefore, the inner cantilevered portion 10*a* of each lower bearing block 10 is normally supported on the upper face of the built-in abutment 11, and the lower face of this lower bearing block 10 is slightly spread apart from the lower edge of the aperture 3.

The upper bearing block 9 and lower bearing block 10 of each pair of blocks are also connected together, as disclosed in French patent 2,645,790, via a resilient coupling device having a tendency to lift each upper bearing block 9 with respect to the lower bearing block 10, and authorizing a limited vertical stroke of the upper bearing block 9 with respect to the lower bearing block 10, this coupling device being not shown in the drawing for the sake of simplification.

The rotary cutting apparatus according to the invention comprises, in its upper portion, a pressure exerting frame 12 which includes a central cross-piece 13 carrying at its ends two pressure exerting vertical jacks 14. The rods of the jacks 14 extend downwardly, and their lower ends are situated just above the cantilevered portions 9*a* of the upper bearing blocks 9 and in contact therewith. The pressure exerting frame 12 is preferably articulated as a whole unit, on one side, about a transverse axle and it can be immobilized in a horizontal position on the apparatus frame by any suitable means.

The vertical pressure exerting jacks 14 are mounted on the cross-piece 13 of the pressure exerting frame 12 in such a manner that the vertical central axis of each one of these jacks 14 is contained in a vertical and transverse plane P situated between a vertical and transverse median plane Pl of the adjacent upper raceway 6 and the adjacent upper bearing block 9. On the other hand, a shim or strut 15, of an adjustable height, is interposed between each pair of upper bearing block 9 and lower bearing block 10. The shim or strut 15 is situated substantially in a vertical and transverse median plane P2 which is common to the two upper bearing block 9 and lower bearing block 10 of a same pair of blocks.

Means are provided for adjusting at will the height of the adjustable shim or strut 15. These means can comprise for example two vertical rods 16, extending from top to bottom through each upper bearing block 9, on either side of the spindle 4*a*, 4*b* of the upper cutting cylinder 4 and of which at least the lower extreme portions 16*a* are threaded and screwed in corresponding tapped holes formed in the lower portion of the block 9. The two extreme portions 16*a* of the rods 16 form the shim or strut 15 and come to bear on the upper face of the lower bearing block 10. At their upper ends, the two rods 16 are rigidly connected to respective pinions 17 in mesh with a common central pinion 18 rigidly connected to a vernier 19. It is thus possible by rotating the vernier 19 to adjust the height according to which the lower portion 16*a* of the rods 16 will extend below the bearing block 9, and to adjust consequently the distance between the two bearing blocks 9 and 10.

When the rotary cutting apparatus according to the invention is immobilized under pressure, the pressure exerting frame 12 extends horizontally and when the two jacks 14 are set under pressure, their rods are pressed downwardly against the two upper bearing blocks 9. The force F produced by each of the jacks 14 is exerted downwardly in a vertical and longitudinal plane B passing by the central axis of the corresponding jack 14, is applied at a point A (FIG. 3) in the horizontal bearing plane on the lower cutting cylinder 5, and is supported by the fixed abutment 11.

The point A where the force F is applied is situated between, on the one hand, the median contact point B between the raceway 6 and the lower cylinder 5 and, on the other hand, the point of contact C between the two bearing blocks 9, 10, via the shim or strut 15. Thus, each spindle 4*a* of the upper cutting cylinder 4 is imbedded, jointly with the extreme portion of the cylinder 4, up to the raceway 6, that is to say over the length of the segment CB.

Figure 3:
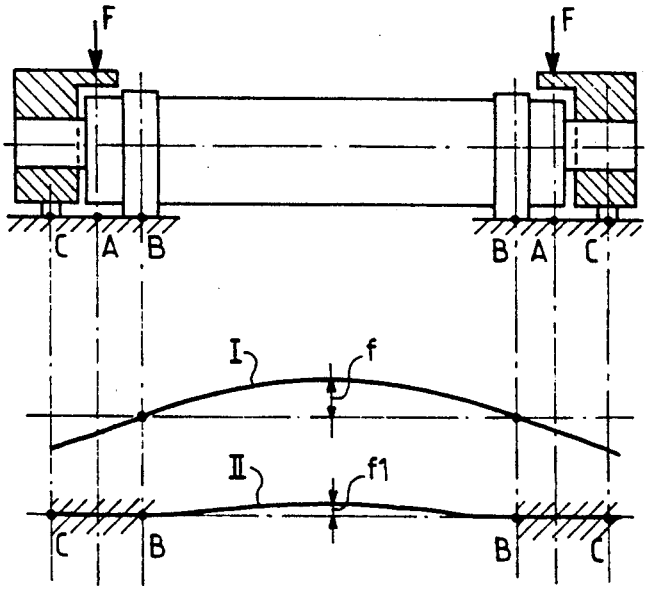
FIG. 3 is a schematic view illustrating the principle used in the cutting apparatus for obtaining the imbedding of the cutting cylinder spindles.

Due to the above imbedding, the deflection which is undergone by the upper cutting cylinder 4 during a cutting operation is much less than in the case where there is no imbedding due to the absence of the shims or struts 15. This is shown clearly by the curves I and II of FIG. 3 showing respectively the cambers f and f1 assumed by the upper cutting cylinder 4 during a cutting operation. The curve I shows the camber f of the upper cutting cylinder 4 in an absence of imbedding, that is to say when the shims or struts are not provided, while the curve II shows the camber f1 obtained with an imbedding along the segments BC.

It is clear from the curves I and II that the camber f1 which is obtained during a cutting operation by means of the apparatus according to the invention is clearly less, in the order of 5 times, than the camber f assumed by the cylinder 4 when there is no imbedding. Such a reduction of the camber of the upper cutting cylinder 4 enables to use, with the same deformation in flexion, cylinders having a diameter equal to two thirds that of cylinders currently used, and consequently to obtain a substantial gain on the costs entailed by the toolings and reception structures, or yet to obtain, with cylinders of same diameter, a quality of the cut which is superior, cleaner and without dust.

What is claimed is:

1. A rotary cutting apparatus comprising: a frame, said frame supporting, between two vertical parallel uprights, two superimposed and parallel cutting cylinders, including an upper cutting cylinder and a lower cutting cylinder, one of said upper and lower cutting cylinders including at least one raceway in rolling contact with the other of said upper and lower cutting cylinders, two opposite coaxial spindles of said upper cutting cylinder being respectively rotatably mounted in two opposite upper bearing blocks vertically slidable on said two respective uprights, while two opposite coaxial spindles of said lower cutting cylinder are respectively rotatably mounted in two opposite lower bearing blocks vertically slidable on said two respective uprights and situated respectively below said upper bearing blocks, each of said upper bearing blocks having an upper cantilevered portion that extends over a portion of the upper roll, said cantilevered portion being subjected to action, in a downward direction, of a pressure exerting vertical jack mounted at an upper portion of said apparatus, and each of said lower bearing blocks having a lower cantilevered portion that extends under a portion of said lower roll, said cantilevered portion extending above an abutment carried by one of said uprights, the apparatus further comprising a shim or strut between each pair of said upper and lower bearing blocks, a central axis of one of said pressure exerting vertical jacks being extended in a first vertical and transverse plane (P), said shim or strut being extended in a second vertical and transverse plane (P2), one of said raceways being extended in a third vertical and transverse plane (P1), said first vertical and transverse plane (P) being situated between said second vertical and transverse plane (P2) and said third vertical and transverse plane (P1).

2. The apparatus as set forth in claim 1, wherein adjusting means are provided for adjusting said shims or struts in height.

3. The apparatus as set forth in claim 2, wherein said adjusting means comprise two vertical rods, with said vertical rods extending from top to bottom through each upper bearing block, on either side of said spindle of said upper cutting cylinder, and a lower extreme portion of at least one of said vertical rods being threaded and screwed into corresponding tapped holes formed in a lower portion of the bearing block, said at least one lower extreme portion of said rods forming said shim or strut and coming to bear on an upper face of said lower bearing block, said two rods having upper ends rigidly connected to respective pinions in mesh with a common central pinion, which in turn is rigidly connected to a vernier.

4. The apparatus as set forth in claim 1, wherein said upper cutting cylinder is provided with two raceways situated at a distance from two frontal faces thereof.

* * * * *